US010798781B2

(12) United States Patent
Emami

(10) Patent No.: US 10,798,781 B2
(45) Date of Patent: Oct. 6, 2020

(54) HORIZONTAL MODULAR HEATER

(71) Applicant: Arsalan Emami, Aliso Viejo, CA (US)

(72) Inventor: Arsalan Emami, Aliso Viejo, CA (US)

( * ) Notice: Subject to any disclaimer, the term of this patent is extended or adjusted under 35 U.S.C. 154(b) by 437 days.

(21) Appl. No.: 15/154,905

(22) Filed: May 13, 2016

(65) Prior Publication Data

US 2016/0338146 A1 Nov. 17, 2016

Related U.S. Application Data

(60) Provisional application No. 62/161,241, filed on May 13, 2015.

(51) Int. Cl.

| | |
|---|---|
| ***H05B 1/02*** | (2006.01) |
| ***F27D 11/02*** | (2006.01) |
| ***F27B 17/00*** | (2006.01) |
| ***H05B 3/14*** | (2006.01) |

(52) U.S. Cl.

CPC ..... *H05B 1/0233* (2013.01); *F27B 17/0025* (2013.01); *F27D 11/02* (2013.01); *H05B 3/143* (2013.01)

(58) Field of Classification Search

CPC .... F27D 1/0036; F27D 19/00; F27D 99/0006; F27B 5/08; F27B 5/14; F27B 17/0025; F27B 7/00; H05B 3/66; H05B 3/08; H05B 1/0233; H05B 3/62; H05B 2203/003; H05B 2203/004; H05B 2203/014; H05B 2203/016; H05B 3/0014; H05B 3/06; H05B 3/143; H05B 3/46; H05B 3/64; H01C 3/20

USPC ..... 219/397, 402, 537, 541, 410, 411, 438, 219/461.1, 481, 531, 534, 536, 538; 373/117, 119, 130

See application file for complete search history.

(56) References Cited

U.S. PATENT DOCUMENTS

| | | | | |
|---|---|---|---|---|
| 3,358,074 | A * | 12/1967 | Himes | H05B 3/16 174/138 J |
| 2008/0296282 | A1* | 12/2008 | Kobayashi | F27B 17/0025 219/385 |
| 2013/0161314 | A1* | 6/2013 | Emami | F27D 11/02 219/397 |
| 2015/0303364 | A1* | 10/2015 | Lievre | H01L 35/32 136/208 |

* cited by examiner

*Primary Examiner* — Serkan Akar
*Assistant Examiner* — Chris Q Liu

(57) ABSTRACT

The invention disclosed is methods, apparatus, and systems of a horizontal modular heater. Whereas the prior art, being heater of a single zone and singular structure, may not be able to provide the desired temperature profile nor efficient downtime during parts breakage is accordingly insufficient for the needs of the industry. The present invention then may be a furnace used in semiconductor manufacturing, of which may be a horizontal heater with multiple modules, of which may be connected in an ingenious method or structure to limit leakage and of which improves efficiency over previous heater designs heaters in the art.

8 Claims, 11 Drawing Sheets

HORIZONTAL MODULAR HEATER

This application claims priority from U.S. Provisional Patent Application No. 62/161,241, filed on May 13, 2015, entitled "Horizontal Modular Heater", which applications are incorporated herein by reference in their entirety for all purposes.

FIELD OF TECHNOLOGY

This disclosure relates generally to furnaces used in semiconductor manufacturing, in one example embodiment, methods, apparatus, and systems of a horizontal interlocking modular heater of which may be specifically suited to manufacturing and processing substrates.

BACKGROUND

Heaters are used in many manufacturing and processing steps, specifically in substrate manufacturing. Heaters are made in many shapes and sizes, but due to space and loading limitations, heating characteristics and other properties, horizontal heaters may be preferred. Further, due to the nature of heating, some conventional heaters have multiple internal zones with different heating profiles, employing a structure such that all the zones are a part of a single assembly, requiring that the entire heater be disposed of or refurbished after failure in any particular zone. As is the nature of a single structure for all the zones, replacement or refurbishment is costly, time consuming, and inconvenient. Most other conventional heater shave only one zone, in which case, one structure and a single set of devices controls or services the single zone, such as one single thermocouple controlling all of the coils and firing at the same intensity. This then causes areas at the ends of the heater to lose heat, with a hotter middle section. Specifically, a diagram of the temperature profile of a conventional heater would be dome-shaped, oscillating up and down. This also provides for inconsistent heating as due to being a simple single structure, heat cannot be controlled as easily throughout the heater, either making the middle much hotter than the ends, of which may cause production problems, or the ends being too hot, of which is a byproduct of needing the middle of the heater to a specific temperature.

One of the reasons for the necessity of replacement or refurbishment of the entire heater upon failure of only one zone or even one part is the use of continuous resistance wire that typically supplies heat to all zones of the heater (generally either three or five zones). Once the resistance wire has a failure, there is no choice but to rebuild or replace the entire heater, of which is inefficient, costly and adds to downtime. This is in addition to any part not easily accessible from the exterior as, if the single part breaks, the entire heater or many parts have to be dissemble for replacement, increasing downtime and losses.

It is then apparent that the prior art is insufficient for the needs of the industry, as single coil heaters with less parts may not be able to provide the desired temperature profile as well as provide for inefficient downtime during parts breakage. The single coil nature of these heaters provides for difficulty in changing out parts, and in addition current multi-zone heaters with one body section and one single coil, of which may cure the temperature differential, still provides for less than efficient downtime as when one part breaks, the entire heater is made dysfunctional, still providing for increased downtime due to a singular structure.

There is then a need a horizontal heater that is modular, of which allows for less downtime and easier replacement of sections of zones of heaters.

SUMMARY

Disclosed are methods, apparatus, and systems of a horizontal modular heater. As disclosed herein, a furnace used in semiconductor manufacturing.

The present invention then may be a furnace of which may be used in semiconductor manufacturing, of which may be a horizontal heater with multiple modules, of which may be connected in an ingenious method or structure to limit thermal leakage and of which improves efficiency over previous heater designs heaters in the art.

The present invention then may describe a horizontal heater with multiple zones. The zones may divide the heater across a longitude line, such that across the heater may be zones of any plurality from one horizontal end to the other. Each zone may be structured such that hardware, structure and mechanical systems may be shared across the zones or limited to each zone respectively. This may allow the heater to function or provide resiliency and ease of repair, and may allow for the replacement and/or continued function of a singular zone in lieu of multiple zones or the unit.

Many applications using furnaces require the furnace structure and heating elements to be responsive to temperature changes and maintain a uniform temperature over some period of time. Yet portions of the furnace structure may not expand at the same rate when the heater is at high temperature. Accordingly, heating elements such as resistance wires may expand, grow, or elongate due to exposure to high temperatures overtime. This may result in cracks and breakage of the furnace structure and may lead to premature failure or breakage in a particular zone.

Many process steps in the manufacturing of semiconductor devices are performed in a furnace. The furnace system may include a wafer loading assembly for transferring wafers to and from the furnace. Other components of the system may include but are not limited to process gases, quartz tubing which may function as a furnace processing chamber and heating elements outside the quartz tube. Heating insulation may be used to insulate the high temperature furnace processing chamber from the room temperature outside ambient. The heating insulation may minimize heat loss, increasing heating temperature and accelerating ramp up rate for the furnace.

In one or more embodiments, the present invention discloses systems and methods of a horizontal modular heater and a furnace utilizing the horizontal modular heater assembly that may include multiple heater zones. The heater zones may include mating features. The zone connections may be designed to provide for increased thermal efficiency and decreased thermal loss.

Many areas of technology require the application of heat to an object or a workpiece according to a specific heating-cooling protocol, referred to herein as "heating protocol" for economy of language, not intending to exclude thereby stages of the protocol in which the workpiece is cooled, or allowed to cool.

Either or both a workpiece and heater may be stationary or movable, which affords the workpiece or heater may be conveniently moved together or individually through several zones such that satisfactory heating is provided. Either process may be used to apply the desired heating protocol to the workpiece. However, for economy of language, and since it is likely to be the most important practical embodiment, the present description focuses on the particular example of the workpiece moving through zones in a stationary heater, understanding that this does not exclude other variations from the scope of some embodiments of the present invention. A preferred embodiment includes a stationary heater, wherein the heater teaches towards a substrate and substrate holder and mechanism are pushed into the heater from one side, left or right, enter the heater such that the substrate reaches the center of the heater and is heated. When the process is done, the substrate is exited the same way the substrate was entered. It is noted that upon entry, the substrate can be ramped up in temperatures within individual zones. Also, it is noted that in other embodiments, the substrate can be moved through the heater from one end and exited through the opposite end, however the preferred embodiment is such that the exit and entrance point is the same.

Additionally, having the zones of the heater having stable temperatures, while the heater or the object being heated moves, provides for less wear and thermal stress on the heater component having to cycle through heating profiles and differentials over their life span, increasing efficiency.

When heaters with multiple zones are used to apply the desired heating protocol to the workpiece, often one zone is subject to more heat loss or higher demand for heat generation (or both) in comparison with other zones of the heater. Such higher demand for energy typically results in faster oxidation of various components comprising the heating elements, often the metal used in resistance wire, and failure of that particular zone before failure of components in other zones.

One important practical example relates to heaters used in semiconductor manufacturing equipment, commonly known as diffusion furnaces. Diffusion heaters follow the pattern mentioned above, having one zone prone to failure before the others. It is commonly observed in diffusion furnaces that heaters in the "load zone," the first zone that the load encounters when it enters the heater, fail before other heater components more than 90% of the time. This zone may allow for access of quartz materials, wafers, one or more boats which carry the wafers, one or more pedestals, and other items. To be concrete in our discussion, the present description describes chiefly the furnaces used in semiconductor manufacturing, which are chiefly horizontal furnaces with the load zone at one end. However, other orientations of furnaces and configurations of furnace zones may also make use of the improvements described herein as would be obvious to a person having ordinary skill in the art.

In this aspect, the method may comprise a horizontal modular heater.

Another aspect of the disclosure may include an apparatus utilizing the assembly of multiple heater modules.

Yet another aspect of the disclosure may include a system of heater modules consisting of mating features, such as a tongue and groove seal, and/or soft seal, to prevent radiation, thermal convection and thermal conduction leakage.

In this aspect, such apparatus may comprise rings, which is a part of the modular feature. The apparatus may also comprise boards, which may include passage cuts and oval holes that may allow heat transfer. They may also interlock with one another to create the round shape of a polygon.

In one or more embodiment, the present invention discloses methods of fabricating a heater board. The boards may include channel cuts and oval cutouts that allow heat transfer and may interlock. The oval cutouts may be on the front side of the board and may allow for heat transfer from the coil to the inside of the heater while creating a support structure to hold the coil in place. The channel cut in the board may be used for placement of the coil. There may be a channel for the wire and the coil in the CNC-machined structure. The channel may be larger than the coil when the wire expands.

The methods and systems disclosed herein may be implemented in any means for achieving various aspects. Other features will be apparent from the accompanying drawings and from the detailed description that follows.

BRIEF DESCRIPTION OF THE DRAWINGS

Example embodiments are illustrated by way of example and are not limited to the figures of the accompanying drawings, in which, like references indicate similar elements.

Figure 1:
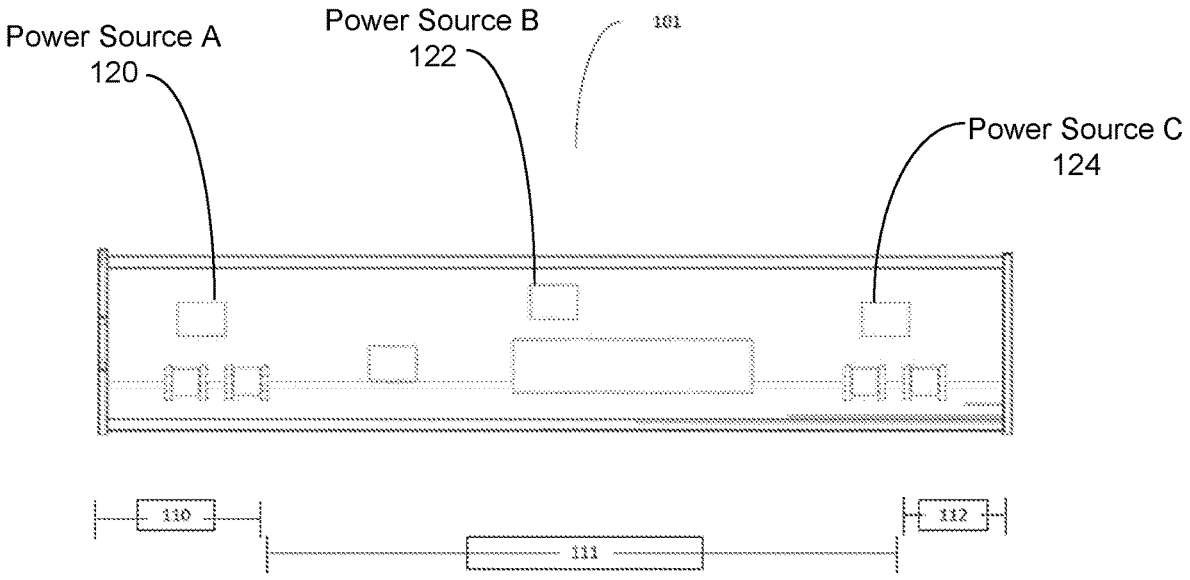
FIG. 1 is a cross-sectional view of a heater structure with zones 1, 2, and 3, according to one or more embodiments.

Other features of the present embodiments will be apparent from the accompanying drawings and from the detailed description that follows.

DETAILED DESCRIPTION

Disclosed are methods, apparatus, and systems of a horizontal modular heater. Although the present embodiments have been described with reference to specific example embodiments, it will be evident that various modifications and changes may be made to these embodiments without departing from the broader spirit and scope of the various embodiments. In addition, the components shown in the figures—their connections, couples, and relationships, and their functions—are meant to be exemplary only and are not meant to limit the embodiments described herein.

Disclosed are methods, apparatus, and systems of a horizontal modular heater, of which may be specifically used in semiconductor manufacturing.

In an embodiment, which may be combined with any other embodiments, the present invention may be a furnace or heater.

In an embodiment, which may be combined with any other embodiments, the present invention may be a horizontal furnace or heater.

In an embodiment, which may be combined with any other embodiments, the present invention may be a furnace or heater with multiple modules.

In an embodiment, which may be combined with any other embodiments, the present invention may be a horizontal furnace or heater with multiple modules or zones.

In an embodiment, which may be combined with any other embodiments, the present invention may be a furnace or heater with multiple modules or zones of which the modules may be connected in an ingenious method or structure to limit thermal leakage and of which improves efficiency over previous heater designs heaters in the art.

In an embodiment, which may be combined with any other embodiments the present invention then may describe a horizontal heater with multiple zones. The zones may be of any plurality depending on the application or design constraints. The zones may divide the heater across a longitude line, such that across the heater may be multiple zones from one horizontal end to the other.

In an embodiment, which may be combined with any other embodiments, each zone or module may be structured from the previous zone, such that hardware, structure and mechanical systems may be shared across the zones.

In an embodiment, which may be combined with any other embodiments, each zone or module may be structured from the previous zone, such that hardware, structure and mechanical systems limited to each zone respectively such that there may be redundancy form zone to zone. This may allow the heater to function or provide resiliency and ease of repair, such as if one part in one zone of the heater breaks, only that section may be replaced or that section disassembled to replace the part, lessening downtime.

In an embodiment, which may be combined with any other embodiments, other sections of the heater may then continue operation if one zone is non-working.

In an embodiment, which may be combined with any other embodiments, each zone or module of the heater then alternatively, each individual parts of the present invention may be detached and reused.

In an embodiment, which may be combined with any other embodiments, quality or specification of parts may be specified by location or zone, such as by using high quality or higher heat tolerant parts in a specific zone, module or section, the lifespan of the heater can be maximized despite of exposure to heat, and different quality or specification parts may be used for different zones based on needs and exposure, such as higher temperature resistant parts used for a higher temperature middle zone, and lower temperature parts used for the outside zones, of which may be used for lower temperature operation of which can save on cost, and improve reliability. Additionally the heater can may be refurbished through detaching and reassembling individual parts. It is noted that in preferred embodiments the zones are at similar temperatures for most or extended periods of times, but in some applications certain zones may be higher or lower, dependent on the applications, such as the middle zone having a higher temperature than the outside zones, or the middle zone having a lower temperature than the outside zones, and wherein the zones may equalize in temperature or have the same temperature throughout the process as well.

In an embodiment, which may be combined with any other embodiments, the heater or furnace may heat using heating elements such as resistance wires. Many applications using furnaces require the furnace structure and heating elements to be responsive to temperature changes and maintain a uniform temperature over some period of time. The furnace structure as well as heating elements typically go through many thermal cycles during their lives. Portions of the furnace structure may not expand at the same rate when the heater is at high temperatures. Such expansion may result in cracks and breakage of the furnace structure. Also, heating elements such as resistance wires may expand, grow, or elongate due to exposure to high temperatures overtime. For example, when these wires are held firmly by ceramic separators at some fixed points for mechanical stability, they may expand or elongate beyond these points, and eventually the wires may come in touch with one another or may touch a "process tube," a glass tube where semiconductor substrates are stacked, leading to premature failure or breakage in a particular zone.

In an embodiment, which may be combined with any other embodiments, the furnace system may include a wafer loading assembly for transferring wafers to and from the furnace.

In an embodiment, which may be combined with any other embodiments, process gases may be introduced to the furnace for processing, of which the gases may be of any type.

In an embodiment, which may be combined with any other embodiments, the furnace may include a quartz tube, forming the furnace processing chamber. Heating elements may be provided on the outside or inside of the quartz tube.

In an embodiment, which may be combined with any other embodiments, each zone or module heating insulation may be used to cover the heating elements, insulating the high temperature furnace processing chamber from the room temperature outside ambient. The heating insulation may minimize heat loss, resulting in higher heating temperatures and faster ramp up rates for the furnace.

In one or more embodiments, the present invention discloses systems and methods of a horizontal modular heater and a furnace utilizing the horizontal modular heater assembly that may include multiple heater zones. The heater zones may include mating features, such as a tongue and groove seal, and/or soft seal, to prevent radiation, thermal convection and thermal conduction leakage. The design of the connections between the zones may provide for increased thermal efficiency and decreased thermal loss. The connection and interlocking structure may be of any type and seal.

Many areas of technology require the application of heat to an object or a workpiece according to a specific heating-cooling protocol, referred to herein as "heating protocol" for economy of language, not intending to exclude thereby stages of the protocol in which the workpiece is cooled, or allowed to cool. These areas may include semiconductor materials processing, semiconductor device manufacture, general materials and surface processing, chemical reaction and process engineering, as well as numerous other examples from modern technology.

Rather than apply the appropriate heating and cooling in situ to a stationary workpiece, it is often convenient for the workpiece to move through a number of different stages or zones in which the appropriate heating or cooling of the workpiece occurs. The workpiece may be moved through several zones in a stationary heater or the heater may be moved so as to cause the workpiece to move through several zones of the heater. Either process may be used to apply the desired heating protocol to the workpiece. However, for economy of language, and since it is likely to be the most important practical embodiment, the present description focuses on the particular example of the workpiece moving through zones in a stationary heater, understanding thereby that a heater moving around a stationary workpiece is not excluded from the scope of some embodiments of the present invention.

Additionally, having the zones of the heater having stable temperatures, while the heater or the object being heated moves, provides for less wear and thermal stress on the heater component having to cycle through heating profiles and differential s over their life span. This further provides for increased efficiency as only the central or hottest heater section parts are exposed to the highest temperature, increasing both the heater's longevity, and also increasing the efficiency of which heat is lost in the heater from the sides, since the substrate will spend the most time at the hottest temperature in the center of the heater, where heat in the side sections may be lost to the ambient, when the substrate is not present in those sections.

When heaters with multiple zones are used to apply the desired heating protocol to the workpiece, often one zone is subject to more heat loss or higher demand for heat generation (or both) in comparison with other zones of the heater. Such higher demand for energy typically results in faster oxidation of various components comprising the heating elements, which are typically the metals used in resistance wire, and failure of that particular zone before failure of components in other zones.

It is noted that the different zones may be any combination of temperature for any purpose, such as a middle zone being hotter or cooler than the end zones. Additionally, any combination of temperatures in a plurality of zones may exist, such as an end zone on one end being a high temperature, an inward adjacent zone being cooler, the next inward adjacent zone being hotter, and then the middle zone being the hottest. It is noted any combination of temperatures in any order, and for any reason may be enlisted.

One important practical example relates to heaters used in semiconductor manufacturing equipment, commonly known as "diffusion furnaces." Diffusion heaters follow the pattern mentioned above, having one zone prone to failure before the others. It is commonly observed in diffusion furnaces that heaters in the "load zone" fail before other heater components more than 90% of the time. The "load zone" refers to the first zone that the load encounters when it enters the heater. Loads in semiconducting manufacturing processes typically include quartz materials, wafers, one or more boats which carry the wafers, one or more pedestals, and other items. The load zone is typically located on one extreme end of the heater, left or right, or depending on the furnace orientation. To be concrete in our discussion, the present description describes chiefly the furnaces used in semiconductor manufacturing that are chiefly horizontal furnaces with the load zone at one end. However, other orientations of furnaces and configurations of furnace zones may also make use of the improvements described herein as would be obvious to a person having ordinary skill in the art.

In this aspect, the method may comprise a horizontal modular heater.

Another aspect of the disclosure may include an apparatus utilizing the assembly of multiple heater modules.

Yet another aspect of the disclosure may include a system of heater modules consisting of mating features, such as a tongue and groove seal, and/or soft seal, to prevent radiation, thermal convection and thermal conduction leakage.

In this aspect, such an apparatus may comprise rings, which is a part of the modular feature. The apparatus may also comprise boards, which may include passage cuts and oval holes that may allow heat transfer. They may also interlock with one another to create the round shape of a polygon.

In one or more embodiments, the present invention discloses methods of fabricating a heater board. The boards may include channel cuts, and oval cutouts that allow heat transfer. They may also interlock to create the round shape of a polygon. The oval cutouts may be on the front side of the board and may allow for heat transfer from the coil to the inside of the heater, while creating a support structure to hold the coil in place. The channel cut in the board may be used for placement of the coil. There may be a channel for the wire and the coil in the CNC-machined structure. The channel may be larger than the coil when the wire expands. Additional room may be needed for the channel to expand into.

The methods and systems disclosed herein may be implemented in any means for achieving various aspects. Other features will be apparent from the accompanying drawings and from the detailed description that follows.

In one or more embodiments, the horizontal modular heater may be used in a furnace and produce heat in thermal design or control applications. A housing may enclose a heating area inside of heater. Housing may be made of any appropriate material such as stainless steel and may generally be of any shape including circular, oval, elliptical, cylindrical, etc. Heater may include a cover that may cover one or more thermocouples and may include one or more standoffs attached to a surface of housing to support the cover. The high performance heater may provide heat generation to an object placed in the heating area inside heater enclosed by housing. Such an object may be any suitable object, structure, element, or component that needs to be heated at a pre-defined temperature range. For example, an object may be a semiconductor wafer. The temperature range may be any suitable range as required, for example, from about 25° C. to 1700° C. For instance, the temperature range for semiconductor wafer applications may be between about 500° C. and 1200° C. In an embodiment, the high performance heater may be used in a furnace and may be controlled by a computer system to a given temperature prior to processing of an object such as a semiconductor substrate.

In one embodiment, the high performance heater may be positioned in different manners, for example, horizontally. Stackable trays may be aligned and linked together in a horizontal direction. The number of linked trays (and heating elements) may vary according to the applications or the number of zones divided in the heating area of heater. In general, linkable trays may have similar shape and construction style. Therefore, the construction and assembly of heater are greatly simplified.

In this or other embodiments, a passage restrictor may be used to control the conductivity of the passages. For example, a ring may be included to control the amount of airflow through the heater. The ring may be adjusted manually or pneumatically by activation of actuators controlled by system controller. In a heater assembly, there may be a flat ring with the same hole pattern and size as the passages of the heater assembly. The ring may move in place to alter the exposed size of the holes. For example, when the holes between the ring and side of the heater are completely aligned, the holes are entirely open. The plate may completely block the airflow by rotating in place. A screw may be used to secure the location of the plate such that it cannot move once the screw is tightened. In some embodiments, a controller may be included to regulate, e.g., by moving the plate, the flow through the passages.

The present invention may disclose a horizontal modular heater, and a furnace having the horizontal modular heater. The horizontal modular heater may include multiple heater zones together with an integrated external shell. The heater zones may include one or more insulation layers and one or more heater elements, coupling together. An external shell may be used, covering all heater zones. Since the external shell may integrate all heater zones, the requirement for the seal between the zones, e.g., the tongue and groove and/or the soft seal, may be relaxed.

In this or other embodiments, the heater zones may be placed against each other to form a large heater zone, and an external shell may cover all heater zones, e.g., the large heater zone. Passages may be provided, for example, between the insulation layer and the external shell for improving control of the zonal heater.

In one or more embodiment, the horizontal modular heater may include multiple heater zones attached to each other, such as by a tongue and groove feature, by a soft seal feature, by mechanically pressing the zones together, or by any combination thereof. The horizontal modular heater may include an external shell, for example, a stainless steel shell, wherein the external shell covers all heater zones. In some embodiments, the external shell is separated from the insulation layers of the heater zones, forming one or more passages between the heater zones and the external shell.

FIG. 1 is a cross-sectional view of a heater structure 101 with zone one 110, zone two 111 and zone three 112, which includes power source A 120, power source B 122, and power source C 124, respectively, according to one or more embodiments. Zone one 110 and zone three 112 may act as buffer for zone two 111, such that zone two 111 has a flat temperature such as to maintain the wafers or substrates within +/−a quarter degree C., and the substrate and wafers may be placed in zone two 111, the middle and the longest section. Zones one 110 and zone three 112 may be buffer zones, with the purpose of bringing up the heat curve (not shown) such that it may be flat when reaching zone two 111. In other words, there may still be a drop in zone one 110 and zone three 112; however, they act as balancers so as to ensure that zone two 111 has a flat temperature before temperature drops off in zone one 110 and zone three 112.

It is noted that in other embodiments not pictured, there may be one zone, or specifically more than one zones, such as four or five or more zones or modules. It is noted that specifically, more than 5 zones are also included in embodiments, such as 6, 7, 8 or 9 zones. Depending on application any number of zones may be used in an embodiment. In one embodiment, which may be combined with any of the above and below embodiments, one or more heater zones may be assembled together to form a large heater zone. The heater zones may include an insulation layer. The heater zones may be mechanically attached to each other, for example, by the vestibules pressing on the insulation layers of the heater zones. The vestibules may be supported by an external shell, which may form a cover for the horizontal modular heater. The external shell and the insulation layers may form a passage surrounding the heater zones. Inlet and outlet openings may be included for providing flow, such as convection flow, to the passage. A plenum may be included to provide forced flow to the passage. A cover may be included to protect the external electrical contacts.

In this or other embodiments, which may be combined with any other embodiments, each zone or module, of which there may be any number zones such as 5 zones, less than 5 zones such as 3 zones, or more than 5 zones such as 7 zones. It is noted that any number of zones may be taught in many embodiments . . . . Zone two may be split into three zones for better control over the product. Zone one may also be larger than zone three because of the pre-heated gas of zone 1.

Figure 2:
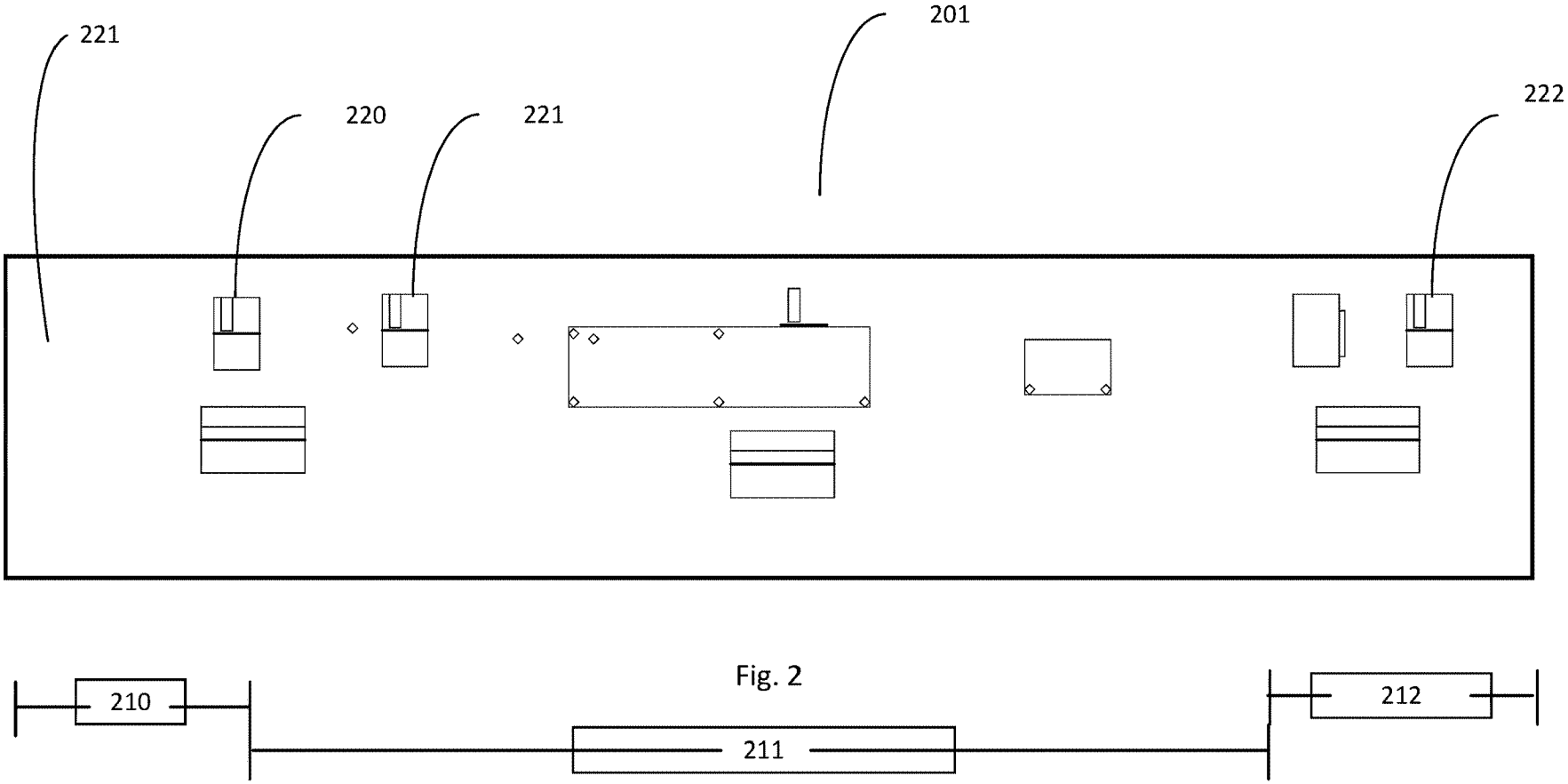
FIG. 2 is a front view of the heater assembly, according to one or more embodiments.

FIG. 2 is a front view of the heater assembly, according to one or more embodiments. The present invention may disclose a heater assembly 201 that may be assembled from multiple heater zones, and the heater zones that may form a heater assembly. In an embodiment, as pictured, the heater may include zone one 210, zone two 211, and zone three 212, but as noted may also include any other number of zones or modules. Each zone may have its own separate heating coils, connected and associated hardware, such as connectors 220 for zone one 210, connections 221 for zone two 211, and connected 222 for zone three 212. For example, a horizontal modular heater described herein may allow the heater to be made in sections that individually make up each zone as noted with zone one 210, zone two 211, and zone three 212. If a zone fails in the horizontal modular heater assembly, the zone or module maybe replaced with a new zone or module and place the system back in use promptly, as the module may be replaced without replacing other zones, and otherwise working hardware. The same advantage applies to vertical furnaces. When the load zone (or other zones) of a vertical furnace fails, only the load zone needs to be replaced. The many benefits of zonal design heaters include major savings in cost, quicker turnaround, and lower allocation of capital for spares, among other things.

Figure 3:
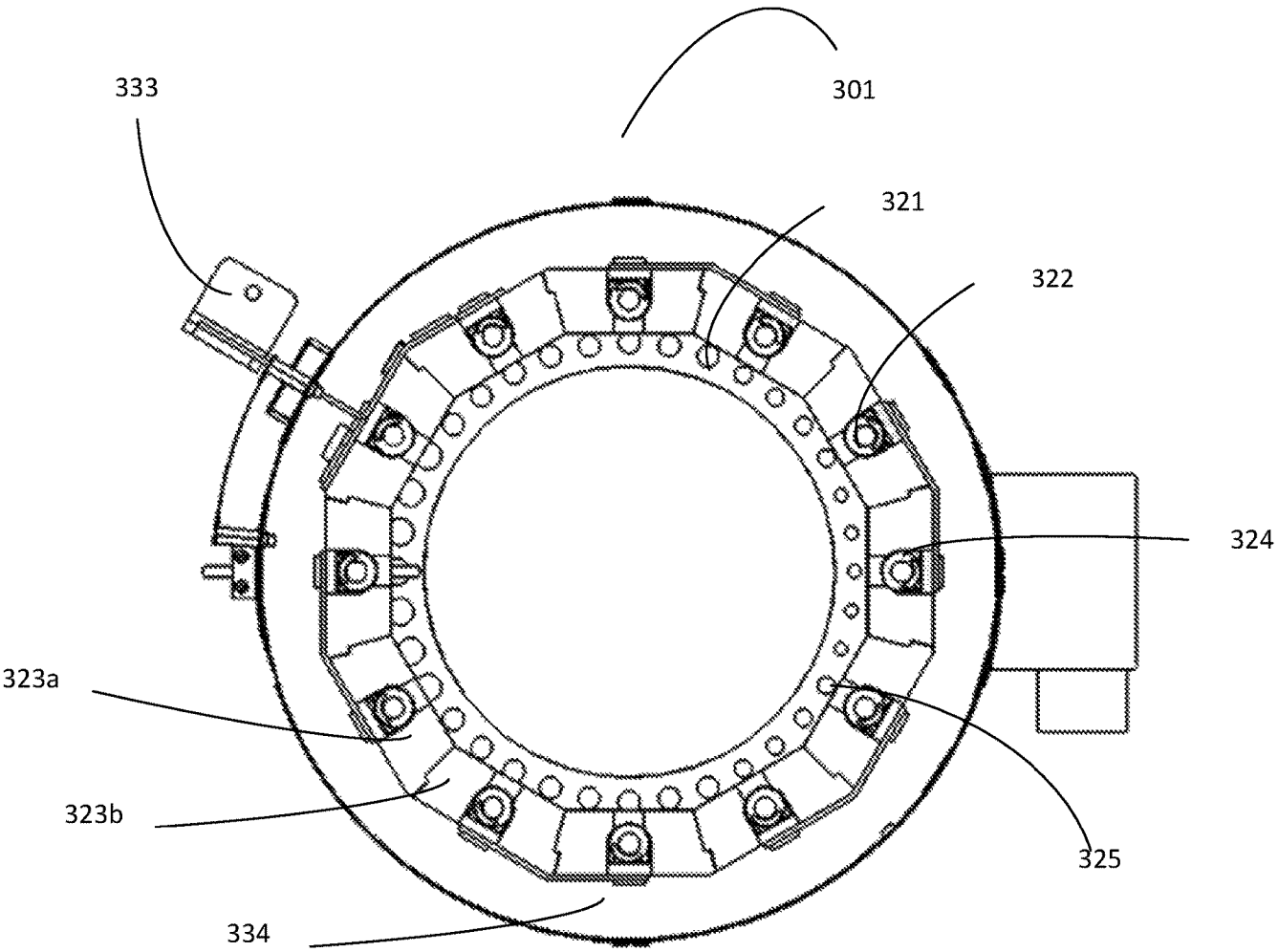
FIG. 3 is a cross-section view of the middle zone of a heater, according to one or more embodiments.

FIG. 3 is a cross-section view of the middle zone of a heater, according to one or more embodiments. A horizontal modular heater 301 may show the heater elements for different zones of the present invention. At the end modules, the heater elements may have larger wire size as compared to the wire size of the heater elements of middle module.

In one or more embodiment, the present invention may have a unique polygon shape structure as seen where the boards 323*a* and 323*b*, for example, create the polygonal shape. It is noted in other embodiments, the shape may be other than a polygon, and may have any plurality of faces.

The boars may have coils or heating elements 322 of which the coils may be placed in pockets that allow easy movement of the coil, without disturbing the other components in the heater, which may result in a longer heater life and easy accessibility for repair.

In an embodiment, the structure of the heater, which may be modular in which the CNC-machined components connect and/or interlock, may be unique in ways in which electricity is connected to the wire. For example, the modular pieces may be detachable, and the components may assemble on top of one another. This may be seen in that the heater 301, may have exampled boards 323*a* and 323*b*, for which the boards may interlock and overlap, as well as the other components, may then interlock or otherwise be detachable on top of one another. It is also noted that within zones, the modules or zones, may overlap or otherwise interlock with each other.

In one embodiment, a horizontal module heater may be assembled from three heater zones. Multiple plates such as plates 323*a* and 323*b* may be used to fasten the heater zones. Heater elements within the heater zones may include external electrical connections such as connector 333. Different heater elements may be used in different heater zones, and thus different heater connectors, plates and other hardware. For example, a short heater element may be used in the short heater zone. A medium heater element may be used in the medium heater zone. Multiple long heater elements may be used in the long heater zone. In addition, the power rating for different heater elements may be different, such as heater wire sizes or materials. For example, entrance and exit zones, e.g., zones may be higher than the middle zone. It is also noted that an insulation layer or façade may be used such as layer 334, wherein the layer may insulate the exterior hardware and ambient from the internal temperature, both for efficiency, safety and longevity.

Empty space may be provided at the sides of the heater elements to allow for the thermal expansion of the heater elements upon heating to high temperatures. A tongue and groove seal may be used to couple the heater zones.

In one or more embodiment, resistance wire of larger diameter may be formed into a spring type coil. The coil may then be placed inside the passages that are machined inside the rectangular boards. The boards may be interlocked against each other and placed in a polygon shape. Center and end rings may have the same shape of the boards machined in them and may serve as a support and a mechanism that brings the structure together. The interlocking boards may create a firm structure, wherein the boards may not be able to sag internally.

In one or more embodiments, the methods of fabricating a heater board is disclosed. The boards may include channel cuts, and oval cutouts that allow heat transfer. They may also interlock to create the round shape of a polygon. The oval cutouts may be on the front side of the board and may allow for heat transfer from the coil to the inside of the heater, while creating a support structure to hold the coil in place. The channel cut in the board may be used for placement of the coil. There may be a channel for the wire and the coil in the CNC-machined structure. The channel may be larger than the coil when the wire expands. Additional room may be needed for the channel to expand into.

Figure 4:
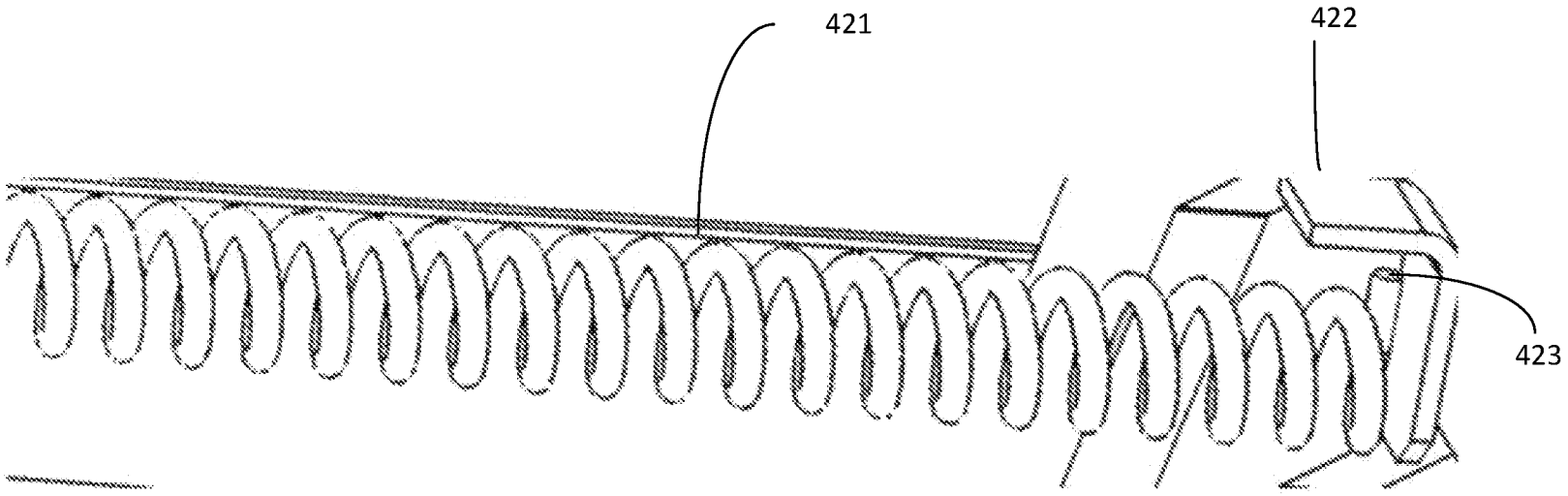
FIG. 4 is a right-side view of a coil and a coil-end coils, according to one or more embodiments.

FIG. 4 is a right-side view of a coil and a coil-end coils, according to one or more embodiments. The L-shaped coil end coils 422 may be made of the same material as the wire 421, of which the material may be of any type. Also, it is noted the end shape may be of any shape or design. Where the coil is fastened such as a point 423, the section of the coil end coils may act similar to that of a spring. When the coil end coils is hot, it may deflect back and forth to absorb the forces. The coils may be also embedded in boards from behind with the oval holes to allow heat transfer.

In one or more embodiments, resistance wires may be connected through a coils, where two of the coils may be fastened together and/or fasten one of the coils on top of the other. The coils may be laid out in such a way that everything comes together. There may be four terminal leads from a cross-section view of the heater. They may be electrical connection points, where high-current power lines may be connected to the heater. Each zone may have external connections for the heater elements, which may be electrically connected to a power source.

In this or other embodiments, bussing may take place underneath the connection points. Coils may be connected to the end coils and fastened to make a connection. Due to the high current that goes through the coils, it may be critical how the coils are bussed together, and/or how electricity goes through them.

A resistance wire may be attached to a first side of a right angle coils. For example, a resistance wire may first be fastened to a front side of a right-angle coils. A second side of the right angle coils may then be attached to a straight coils that connects together all the heating elements located in different zones. For example, the back side of the right-angle coils may be fastened to the straight coils that connects all of the wires in different trays together. The first side of the right angle coils may flexibly support movements of the heating element(s) during one or more temperature changes of the heater. As such, the first or front side of the right angle coils, which is inside a heating area, may act as a spring that supports the expansion and contraction of a heating element (e.g., wire) during heating and cooling of the heater. This behavior of the right angle coils thus removes any tension associated with elongation and contraction of the heating element from the heating element itself, improving the life of the heating element.

Fastening, and in particular, electrical fastening and connections, are more reliable when, at minimum, two sides of a part are connected or fastened instead of just a single point of connection. In the embodiment described above, the back side of the right-angle coils makes two fastened connections with the straight coils that connect the wire from one zone to another. The dual connection, along with overlapping material, makes for a most reliable technique, however any other technique or structure may be used.

In one or more embodiments, the terminal leads also have a connection with the coils connecting the outside power to the heater.

The resistance wire for heating may be used in the form of a coils and attached to the insulation block by fasteners or welds or other suitable fasteners, and as such may also be welded, or at least welded at the power connection points. The fasteners or welds may be made of a high temperature insulator material, for example, a similar ceramic material as the outer coating of the resistance wire or coils, or may all be made of the same or different materials.

In one or more embodiment, the heater elements may use coils. The coils may expand only in one direction as the coils temperature increases. Reserved space may be provided to allow the coils to expand and retract freely as needed. The coils may be placed or fastened at locations that may allow free movement of the coils in the direction of elongation, such as along the length of the coil wire, and not at the end of the coil wire. In addition, the coils may be positioned or fastened in such a way such as may be loosely attached so as to provide some ability for the coil wire to move as needed. The coil wires may be shaped in any form such as, spring shaped form, or other forms.

In one or more embodiment, round wires may be used, with the insulation layer designed to account for the elongation and movement of the round wire at higher temperatures. The round wires may be placed in passages in the insulation layer. Additional cavity in the insulation layer block at the turning point of the round wires may allow for expansion of the round wires at higher temperatures. In some embodiments, the fastener or weld may hold the coil wire in place.

In one or more embodiment, the insulation layer may have a lower edge, for example, fabricated as an integral part of the insulation layer (or sections of the insulation layer). This lower edge may provide support to the bottom of the heater elements, such as coil wires or round wires, and may also act as an insulator between the heater elements of adjacent heater zones. The fastener or weld may anchor the heater elements such that the heater elements are isolated, e.g., do not come in contact with one another.

In some embodiments, a vestibule block may be included at one or both ends of the horizontal modular heater to provide support for the zones at the ends of the heater.

Figure 5:
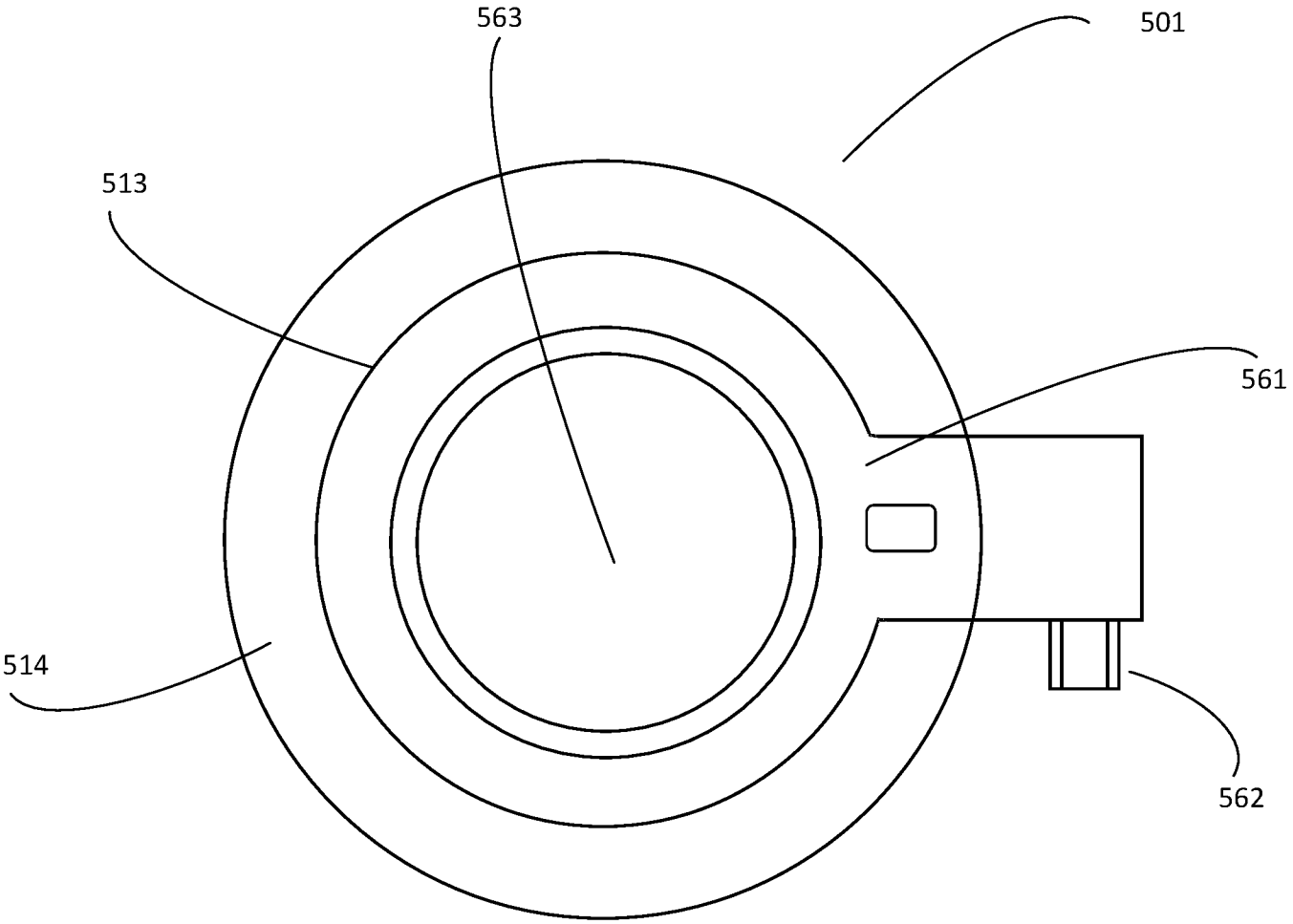
FIG. 5 is a front view of the forced air cooling inlet and/or outlet, according to one or more embodiments.

FIG. 5 is a front view of the forced air cooling inlet and/or outlet, according to one or more embodiments. Inlet and outlet openings may be included for providing flow, such as convection flow, to the passage.

The heater 501 may include heater inlet passage 561, of which may send forced air to directly enter the interior recess 563 of the heater, or may provide for laminar air ability, such as the passage to encompass or surround the interior recess and uniformly insert air into the recess. The air may be fed through an inlet 562, of which any gas, air of any temperature, or substance may be entered either from the heater itself, or auxiliary machinery or sources. It is noted that the air and gas may be recycled directly, after processing or recycling such that efficiency is increased.

In one or more embodiment, three heater zones may be assembled to form a horizontal modular heater. Insulation layers as seen to be insulation layer 514 may be used to insulate and protect the heater elements, which is position within the insulation layer 514, such as on the interior of layer 514, at 513. Each zone may have external connections for the heater elements, which may be electrically connected to a power source. A heater zone may have one or multiple heater elements. For example, a shorter section heater zone may have one heater element, while a long section may have multiple heater elements to provide uniform heating profiles. The multiple elements may be electrically coupled within the heater zone or may have external connections, which may provide electrical connections at the outside of the heater.

In this or other embodiments, a heater element in the form of a round wire may be embedded in an insulation layer, for example, in a recess such as on the interior side of layer 514 at 513. Electrical contact may be included to pass the heater element to an external connection. The recess may be designed to allow room for thermal expansion. The recess may also provide a passage for placing the heater wire. Fasteners or welds may loosely hold the heater element in place, preventing the heater element from excessive movement, but still allowing some movement, e.g., within the passage. Fasteners or welds may be secured to the back of the insulation layer, for example, by locknuts.

Figure 6:
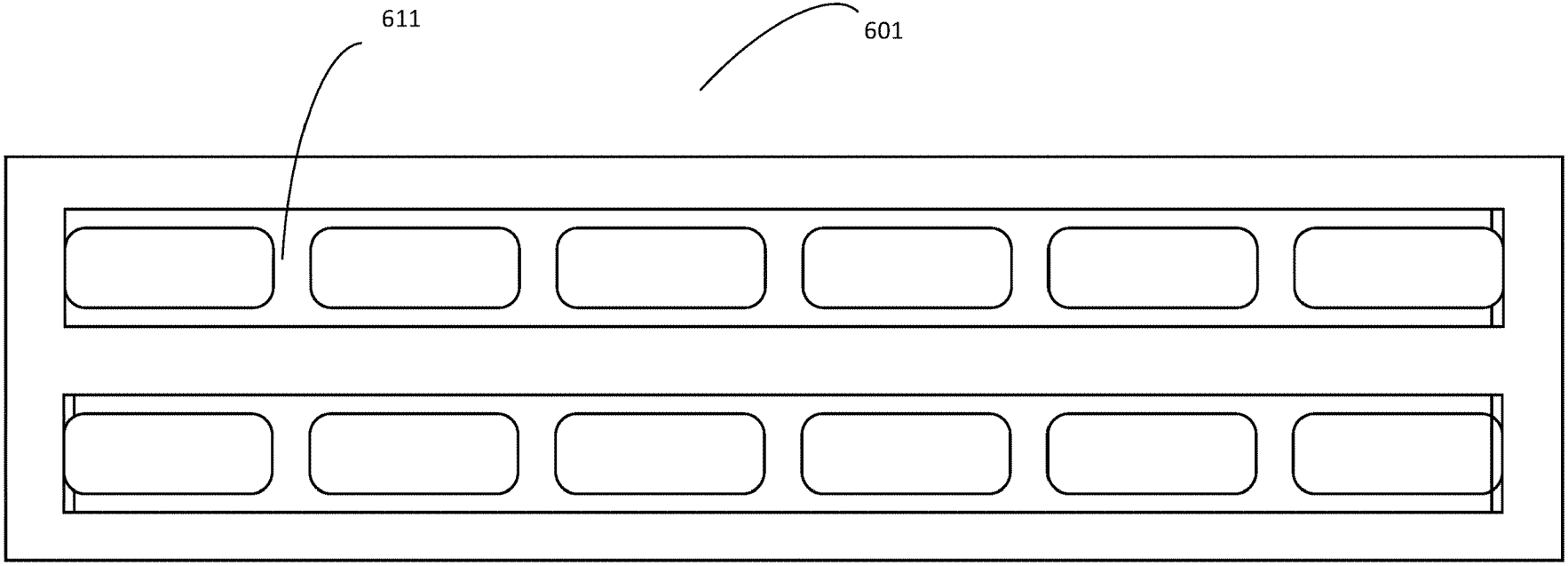
FIG. 6 is a back-side view of a heater coil board, according to one or more embodiments.

FIG. 6 is a back-side view of a heater coil board, according to one or more embodiments. The present horizontal modular heater 601 may include heater elements, such as resistance wires for heating. For example, each zone of the horizontal modular heater may include an insulation block 611, which may include either a single piece of insulation or one or more components integrally joined together to make up the insulation block surrounding that particular furnace module.

Figure 7:
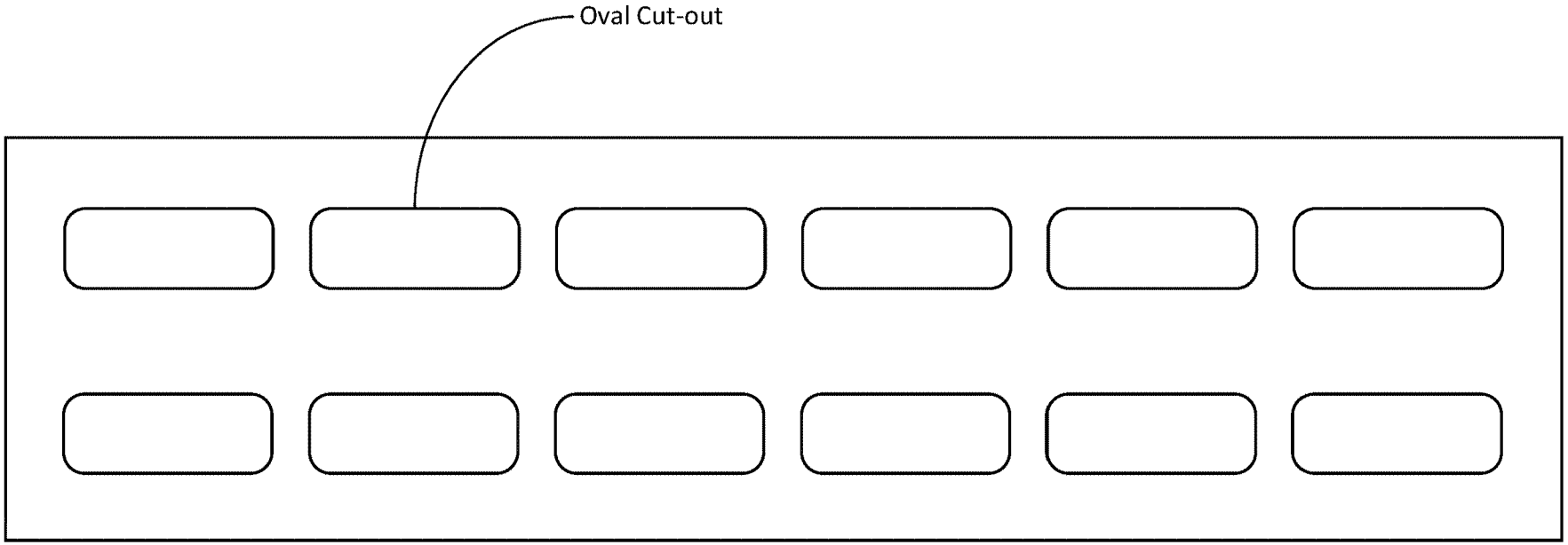
FIG. 7 is a front-side view of a heater coil board, according to one or more embodiments.

FIG. 7 is a front-side view of a heater coil board, according to one or more embodiments. A heater element, such as a coil wire or a round wire may be fastened to an insulation layer, for example, by multiple fasteners or welds. The heater elements may be placed on the surface of the insulation layer. A lower edge support may be used to support the heater element. The lower support may be an integral part of the insulation layer. The fasteners or welds may be placed along the heater elements, configured to allow the heater element to expand, e.g., at the top portion opposite the lower support. The fasteners or welds may also be loosely fastened to the heater elements, for example, to allow the heater elements to expand somewhat in the horizontal direction. The fasteners or welds may be fastened to the insulation layer, or may pass through the insulation layer, and secured at the backside of the insulation layer.

In this or other embodiment, a heater element, such as a coil wire or a round wire may be fastened to an insulation layer, for example, by multiple fasteners or welds. The heater elements may be placed in a recess of the insulation layer. The recess may contact the heater elements at the bottom portion, for example, to provide support for the heater elements. The recess may have an empty portion for example, to allow the heater elements to expand and still stay within the recess area. The heater elements may be loosely placed in some portions of the recess, such as the horizontal portions, to allow the heater elements to expand somewhat in the horizontal direction. The fasteners or welds may be placed along the heater elements, configured to allow the heater element to expand. The fasteners or welds may also be loosely fastened to the heater elements, for example, to allow the heater elements to expand somewhat in the horizontal or vertical direction. The fasteners or welds may be fastened to the insulation layer or may pass through the insulation layer, and may be secured at the backside of the insulation layer.

In one or more embodiment, the heater elements, e.g., the heater size, may be optimized based on the thermal energy demand for each zone. Typically heaters used for diffusion furnaces or other applications, utilize one resistance wire or coils size to construct the entire heater. That means all of the zones, regardless of their location and demand requirements, may be made of the same size and specification wire or coils. In this case, the zone with the higher demand, such as zone 5, may fail before the other ones. The present invention may disclose a horizontal modular heater which may optimize each heating zone with the most suitable wire or coils size for optimum performance. For example, zones located at the ends of the heater may be subjected to more heat loss. These zones may be made with higher diameter wire or thicker coils. Employing larger amounts of resistance wire or coils material may proportionally extend the life of the zone. Varying the cross sectional size of the resistance wire or coils in different zones of the horizontal modular heater may also be employed with some embodiments of the present invention, an advantage and design flexibility not available in conventional heaters.

Figure 8:
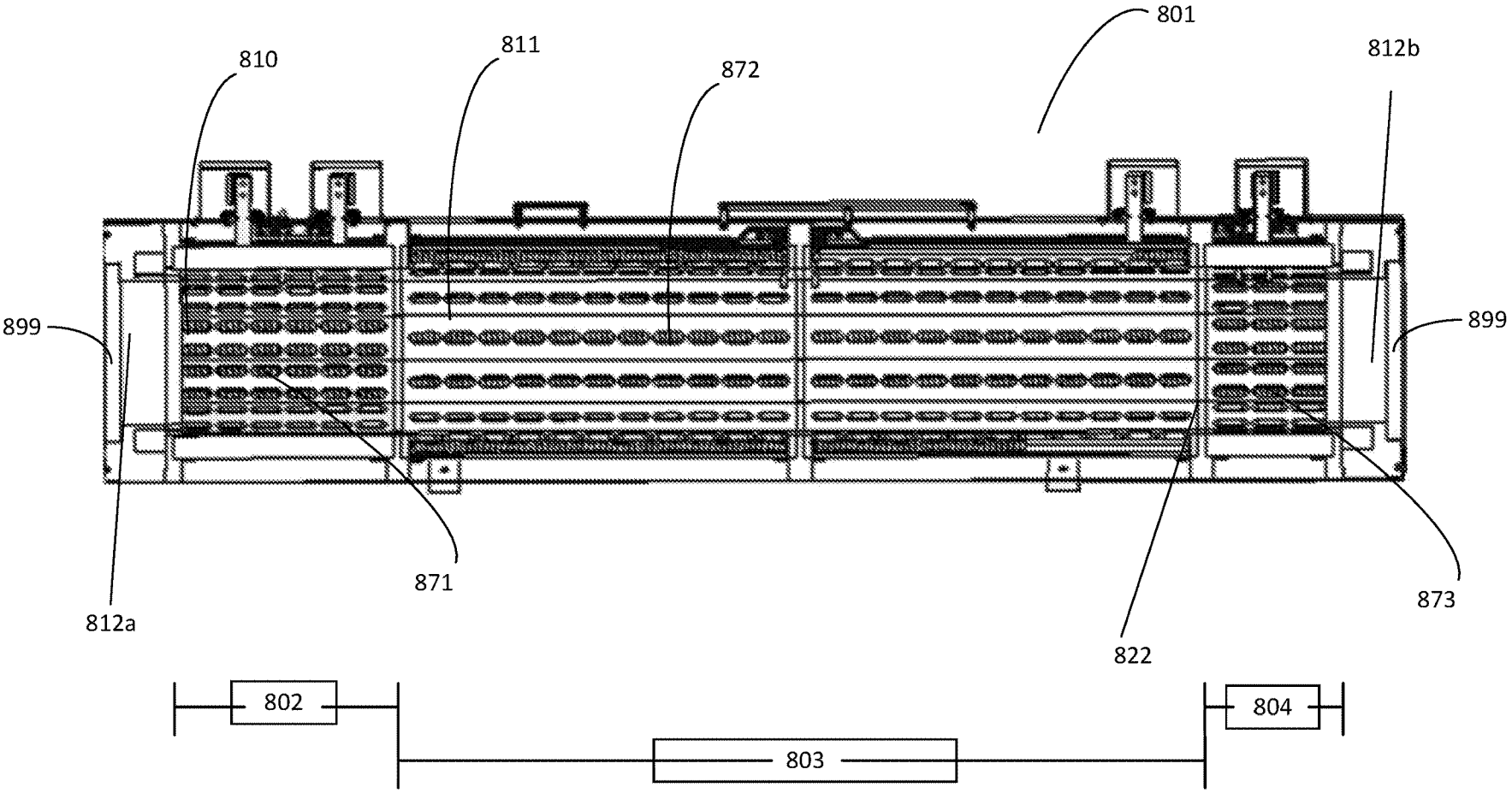
FIG. 8 is a side view of a heater coil board, according to one or more embodiments.

FIG. 8 is a side view of an embodiment of the present invention heater, wherein the exterior façade is not pictured. The view teaches to a horizontal heater 801 of which may have to the coils 810 being mounted on the interior of a board 811, of which it is noted that the board is split into multiple boards by zone or module, of which may be zone one 802, zone two 803, zone three 804, or any other plurality or combinations of zones, of which may be heated to different temperatures or characteristics, according to one or more embodiments. The present invention may disclose a modular heater with improved temperature controls. Temperature may be adjusted by any means, and may be monitored by any plurality of sensors, control modules, and may be automatic or manually operated on site, remotely, or by a technician or computer system and may include adjustment of any system such as the air within the heather, the temperature or duration of heating the heater elements, or any other combination or method or system. An ingenious temperature control of the heater recess maybe performed in an embodiment by the introduction of air, such as forced air, into the recess. Passages 811 may be incorporated with the insulation layer or block 811 to change boundary conditions of the insulation layer, affecting the heating or cooling rates of the furnaces. Natural convection flow or forced flow may be used within these passages, and may be forced air or any other gas of which may be introduced by any means and through air distribution passages, recesses or any other method as mentioned in other embodiments.

In some embodiments, a plenum 812*a* and plenum 812*b* may be positioned at one end of the passages for providing flows to the multiple passages. A plenum airflow through the insulation may be controllable by the use of various speeds for the blower generating the airflow. A controller may be included to control the flow, for example, through the software operating the system, or by a mechanical switch directly operating the blower. In some embodiments, the desirable airflow rate may be dependent on the temperature inside the heater, which may further optimize the cool down rate. For example, the airflow may be lower at higher temperatures and then increases as the heater cools down to lower temperatures.

In this or other embodiment, each heater zone may have a heater element insulated by an insulation layer. A configuration of seals 822 may be used to couple the heater zones, of which maybe tongue and groove seals, but also may be any type of seal or connections. For example, a heater zone may have a tongue and/or a mating groove to attach to another heater zone. An insulation layer may have multiple embedded passages, which may be configured to be aligned with each other when the zones are assembled. A plenum may be placed at one end, e.g., the bottom, of the passages, providing fluid flow, e.g., gas or liquid flow, to the multiple passages. A flow provider, such as a blower for gas flow or a liquid pump for liquid flow, may be coupled to the plenum to provide forced gas or fluid flow. A controller may also be included to control the fluid flow to the plenum, and/or to the passages, of which the controller maybe externally or internally controlled. A plate may be placed at another end, e.g., the top, of the passages to control the fluid flow through the passages. For example, the plate may include multiple holes, which may be aligned with the passage exit openings FIGS. 9A, 9B and 9C may be an end view of the heater and wherein 9B is a partial cross section showing an air distribution plate, according to one or more embodiments.

Figure 9C:
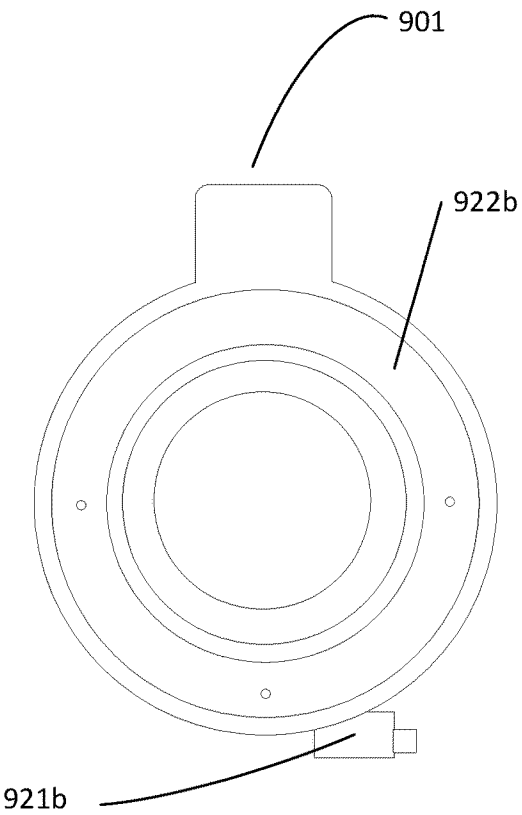
FIGS. 9A, 9B and 9C may be an end view of the heater and wherein 9B is a partial cross section showing an air distribution plate, according to one or more embodiments.
Figure 9B:
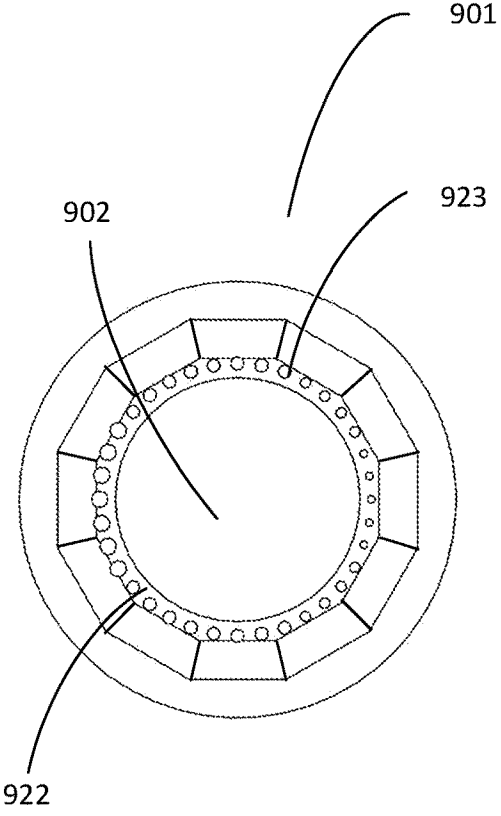
Figure 9A:
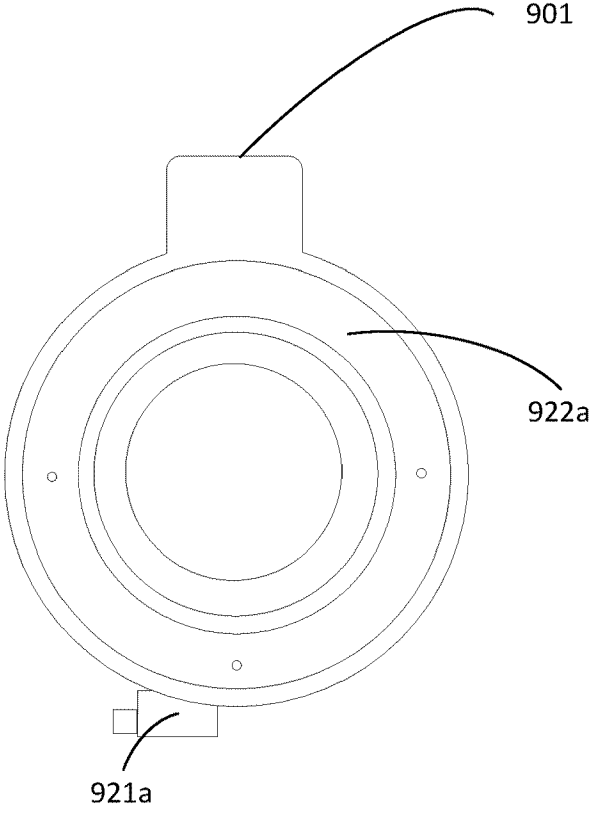

FIG. 9A may show a side view of the horizontal heater 901, wherein forced air may be provided within inlet 921*a*, of which may then travel through a conduit, layer recess or otherwise to a distribution layer, conduit or recess behind plenum 922*a*, of which may spread air across the interior of the captive plater and heater structure, of which is described in FIG. 9B.

FIG. 9B then describes wherein the side structure is shown within the plenum in a cross section. The air may then collect in the area between the 901 heater structure and the 922*a* plenum such as between the plate and surface 922 and may then be forced into holes 923, of which may then either force air across the heater, and enter the recess 902, or may travel along the heater itself, without entering the recess.

FIG. 9C shows the other side of the heater, wherein the forced air may be forced into 921*b* outlet for removal by plenum 922*b* using the same principles of the inlet distribution plenum 922*a*

The rings may work similar to that of an air distribution plate. The size of the holes may vary from one side to the other to even out the air flow through the heater due to the position of the inlet and/or outlet. The polygon-shaped groove may be where the boards go in through. They may also lock together and the ring may hold them together. There may be a bussing structure, with coils embedded in boards from behind the oval holes that allow heat transfer. For example, there may be three rings across the heater, where three zones may come together.

In this or other embodiments, there may be two distribution plates at the end and three rings in the middle, where the zones come together and where the two parts come together. The rings may bring the boards together and lock them in close proximity to one another. The rings may also act to center the heater. The outer parts of the ring touches the stainless shell, where they may move around, which goes along with the boards and the way the boards may interlock with one another and form the shape of a polygon.

In one or more embodiment, the zonal pieces are detachable. The rings may be a part or component of the feature. Where zone 1 and zone 2 meet, there may be a one-piece spacing or plating between them. As zone 1 and zone 2 extend outward, the spacing or plating between them may become wider. The next spacing or plating it touches may be the outer stainless shell. They may be integrated parts of the structure. Additionally, the inside of the rings may be cut exactly like the boards, which may create a clean surface. The inside of the rings may be cut into the shape of a polygon. The inside of the ring, where the air flows, may be clear with no obstacles for air flow.

Figure 10:
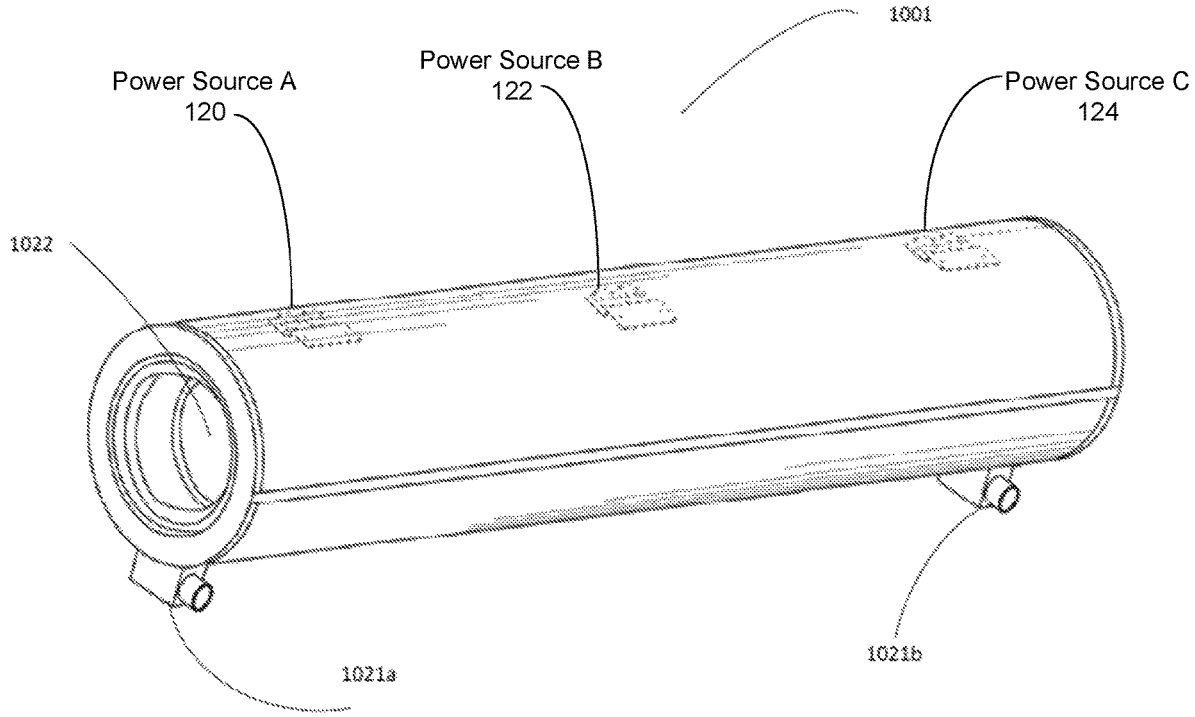
FIG. 10 is a perspective view of the horizontal heater according to one or more embodiments.

FIG. 10 is a perspective view of the horizontal heater according to one or more embodiments. Each zone of the heater may include a separate power source, such as power source A 120, power source B 122, and power source C 124. In an embodiment, horizontal heater 1001, may include forced gas inlet 1021*a* and outlet 1021*b*, of which may be of any plurality, and may be switched, or wherein one or both may act as an outlet or inlet respectively. The inlet 1021*a* and outlet 1021*b* may provide for a gas or forced air of which may introduced into the interior recess 1022 for any purpose, such as for cooling, or for heating such as convection. The gas may be of any type, pressure, temperature, and may be heated processed, recycled or otherwise modified before insertion into the recess by the heater or by any processing equipment onsite or offsite.

FIGS. 11A-11F are cross sectional views of the horizontal heater, particularly displaying the insulating blocks, according to one or more embodiments.

Figure 11A:
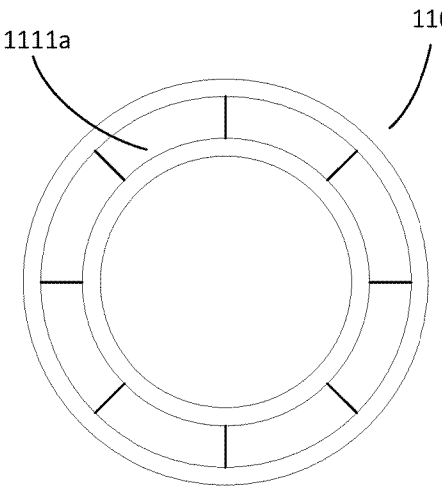
FIGS. 11A-11F are cross sectional views of the horizontal heater, particularly displaying the insulating blocks, according to one or more embodiments.

FIG. 11A teaches to a cross sectional view looking at one end of the horizontal heater, wherein the embodiment teaches to horizontal heater 1101*a* having disparate insulation blocks 1111*a*, wherein the blocks together create a circular or semi-circular insulation layer.

It is especially noted that in the above FIG. 11A embodiment, and in any embodiment, the plurality of blocks, and angled sides, if applicable, may be of any plurality.

It is also noted that the blocks may be positioned and designed in such a way wherein the coils are easily fastened or positioned within the recess and with the blocks, such that a ease of replacement, repair, removal, or removal of a zone, coils, blocks or any other hardware is facilitated.

Figure 11B:
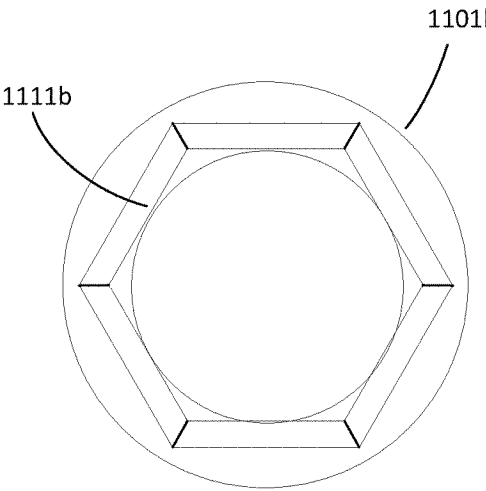

FIG. 11B teaches to a cross sectional view looking at one end of the horizontal heater, wherein the embodiment teaches to horizontal heater 1101*b* having disparate insulation blocks 1111*b*, wherein the blocks together create a polygonal such as a hexagonal insulation layer.

Figure 11C:
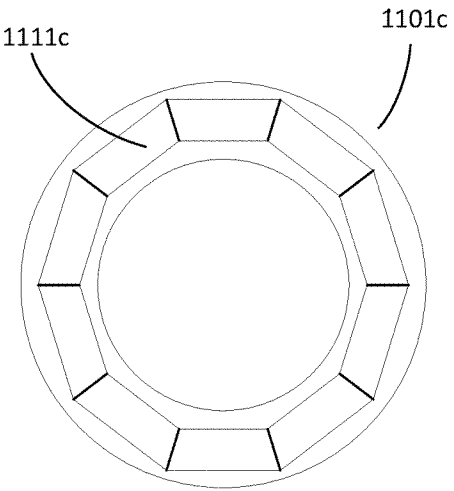

FIG. 11C teaches to a cross sectional view looking at one end of the horizontal heater, wherein the embodiment teaches to horizontal heater 1111*c* having disparate insulation blocks 1111*c*, wherein the blocks together create a polygonal such as a decagonal insulation layer.

It is especially noted that the insulation layer, as previously mentioned may include any number of insulation block parts, and sides, such as to create any shape, geometry, such as those mentioned, but any others such as triangular, quadrilateral, pentagonal, heptagonal, octagonal, dodecagonal, or any other n-sided polygon, or shape.

FIG. 11C teaches to a cross sectional view looking at one end of the horizontal heater, wherein the embodiment teaches to horizontal heater 1111*c* having disparate insulation blocks 1111*c*, wherein the blocks together create a polygonal such as a decagonal insulation layer.

Figure 11D:
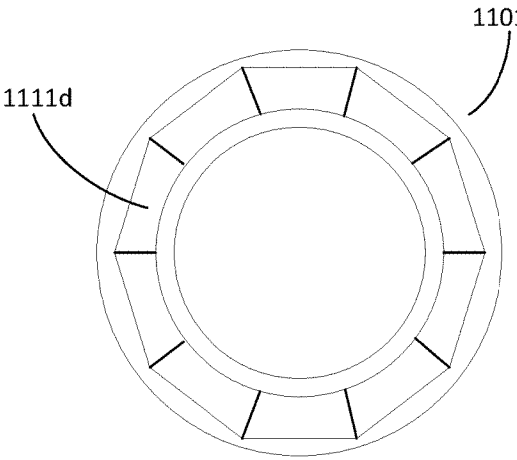

FIG. 11D teaches to a cross sectional view looking at one end of the horizontal heater, wherein the embodiment teaches to horizontal heater 1111*d* having disparate insulation blocks 1111*d*, wherein the blocks together create a polygonal shape on the exterior of the block layer, wherein the blocks are of a straight side on their exterior side, and on the interior the blocks create a circular shape.

Figure 11E:
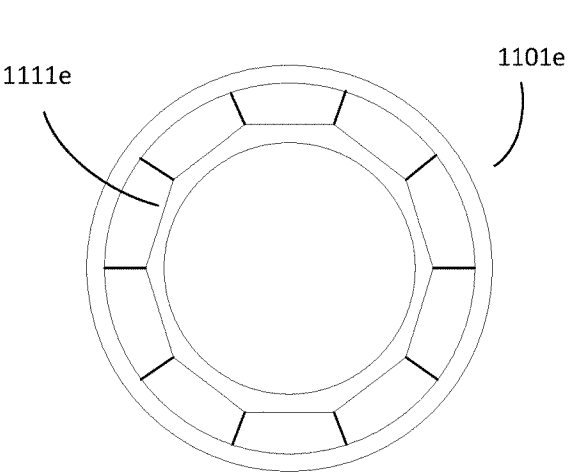

FIG. 11E teaches to a cross sectional view looking at one end of the horizontal heater, wherein the embodiment teaches to horizontal heater 1111*e* having disparate insulation blocks 1111*e*, wherein the blocks together create a polygonal shape on the interior of the block layer, wherein the blocks are of a straight side on their exterior side, and on the interior the blocks create a circular shape.

It is especially noted that the combination of shapes may be of any combinations, wherein the inside and outside maybe of different shapes for any reason, such as for design criteria or space saving, as well as any other reason such as for ease of ability to fasten the heater coils to the insulation blocks.

Figure 11F:
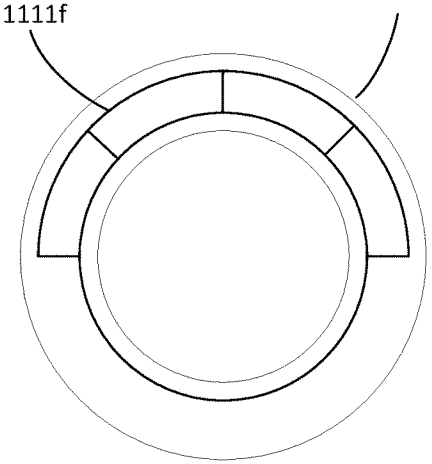

FIG. 11F teaches to a cross sectional view looking at one end of the horizontal heater, wherein the embodiment teaches to horizontal heater 1111*f* having disparate insulation blocks 1111*f*, wherein the blocks together create a shape, of which can be circular, as pictured or also polygonal or a combination of shapes as aforementioned. In an embodiment shown in FIG. 11F, it is especially noted that the insulation blocks in some embodiments may only span or surround the interior heater recess partially, or not completely. This may be due to any reason, such as costs restraints, or to limit materials, such as if the coils are only fastened to the top of the heater, then the insulation on the bottom of the heater may not be needed in some embodiments.

A number of embodiments have been described. Nevertheless, it will be understood that various modifications may be made without departing from the spirit and scope of the claimed invention. In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

It may be appreciated that the various systems, methods, and apparatus disclosed herein may be embodied in a machine-readable medium and/or a machine accessible medium compatible with a data processing system (e.g., a computer system), and/or may be performed in any order.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. A heater, comprising:

an external shell;

a plurality of zones, wherein the plurality of zones divide the heater across a longitudinal line such that the zones are disposed across the heater from one horizontal end to the other, and the plurality of zones oriented horizontally are joined together by a tongue and groove feature, a soft seal feature, mechanically pressing the zones together, or by any combination thereof, wherein the zones comprise structural redundancy for permitting replacement of a zone, wherein each zone includes:

one or more insulation layers couple to one or more heater elements, wherein the insulation layers comprising a plurality of insulation layer blocks for insulating the heater elements from an ambient temperature;

the one or more heater elements disposed on an interior of the insulation layer, wherein the one or more heater elements configured in the longitudinal line spanning the heater's length;

a separate power source, wherein the one or more of heater elements in other zones of the plurality of zones is configured to continue to operate when one zone of the plurality of zones is non-operational, wherein each zone is configured to be detachable from the heater for replacement, wherein the heater elements comprises an L-shaped end configured to deflect backward and forward at high temperatures for removing tension on the heater elements, wherein each of heater element fastened to one of the insulation layers by one or more welds, and the one or more welds are disposed away from the heater element's end for permitting movement of the heater element, and wherein each of the insulation layers comprises a cavity for expansion of the heater elements.

2. The heater of claim 1, further comprising: wherein adjacent insulation layer blocks are joined at a plurality of edges of each insulation layer block for limiting thermal leakage.

3. The heater of claim 1, wherein a bottom portion of the heater element is supported by a lower support edge of the insulation layer, wherein a top portion of the heater element is configured to expand into the empty cavity, and wherein the lower support edge insulates heat convection from an adjacent zone.

4. The heater of claim 1, wherein the plurality of insulation layer blocks are configured to interlock with adjacent insulation layer blocks at multiple edges for limiting thermal leakage from the heater, and wherein the plurality of insulation layer blocks is configured into a polygon shape.

5. The heater of claim 1, wherein the heater element of each zone functions independently among all zones.

6. The heater of claim 5, wherein a temperature resistance rating of the heater elements is based on zone position.

7. The heater of claim 6, wherein the temperature rating of the heater element in a middle zone is lower than that of the heater element in an end zone juxtaposed to an ambient.

8. The heater of claim 1, further comprising:

a pair of vestibule blocks disposed at both ends of the heater for mechanical attachment of the heater, wherein the heater is positioned horizontally during operation, wherein the pair of vestibule blocks press on the insulation layers, and wherein the pair of vestibule blocks is supported by the external shell.

* * * * *